US005161278A

United States Patent [19]

Tomm

[11] Patent Number: 5,161,278

[45] Date of Patent: Nov. 10, 1992

[54] HANDLE CONNECTOR WITH ANTI-LOOSENING LOCK

[76] Inventor: Erwin Tomm, 3320 W. 130th St., Cleveland, Ohio 44111

[21] Appl. No.: 806,116

[22] Filed: Dec. 12, 1991

[51] Int. Cl.[5] ..... A46B 5/00

[52] U.S. Cl. ..... 15/159.1; 15/145; 16/114 R; 403/299; 403/342

[58] Field of Search ..... 15/145, 176.2, 159 R; 16/114 R; 403/287, 290, 299, 342, 343

[56] References Cited

U.S. PATENT DOCUMENTS

| | | | |
|---|---|---|---|
| 1,229,843 | 6/1917 | Whitaker | 403/343 |
| 2,497,384 | 2/1950 | Young | 403/343 |
| 3,682,516 | 8/1972 | Savage | 15/145 |

FOREIGN PATENT DOCUMENTS

| | | | |
|---|---|---|---|
| 252187 | 1/1988 | European Pat. Off. | 403/299 |
| 351457 | 4/1922 | Fed. Rep. of Germany | 403/299 |
| 463527 | 7/1928 | Fed. Rep. of Germany | 403/343 |
| 565630 | 1/1924 | France | 403/343 |
| 1239169 | 6/1960 | France | 15/145 |
| 1249452 | 11/1960 | France | 403/299 |
| 114469 | 4/1926 | Switzerland | 403/299 |
| 159918 | 4/1933 | Switzerland | 15/145 |
| 191817 | 9/1937 | Switzerland | 15/145 |
| 273355 | 5/1951 | Switzerland | 403/299 |
| 286821 | 3/1953 | Switzerland | 15/145 |
| 211354 | 2/1924 | United Kingdom | 403/343 |

*Primary Examiner*—Harvey C. Hornsby
*Assistant Examiner*—Mark Spisich
*Attorney, Agent, or Firm*—Fay, Sharpe, Beall, Fagan, Minnich & McKee

[57] ABSTRACT

An improved broom assembly comprises a head member having an internally threaded handle receiving opening formed therein with a handle connected with the head member by a manually releasable connector assembly positioned between the head member and a first end of the handle. The connector assembly includes an elongated, generally cylindrical connector body having a first end threadedly received in the handle receiving opening in the head member and a second end joined to the first end of the handle. A locking member having a generally annular shape is axially slidable on the connector body with a first end of the member having teeth-like protuberances extending toward the head member. Splines are provided for preventing rotation of the locking member relative to the connector body, and a threaded nut is carried on the connector body for actuating the locking member toward the head to cause the teeth-like protuberances to lockingly engage the head member.

12 Claims, 2 Drawing Sheets

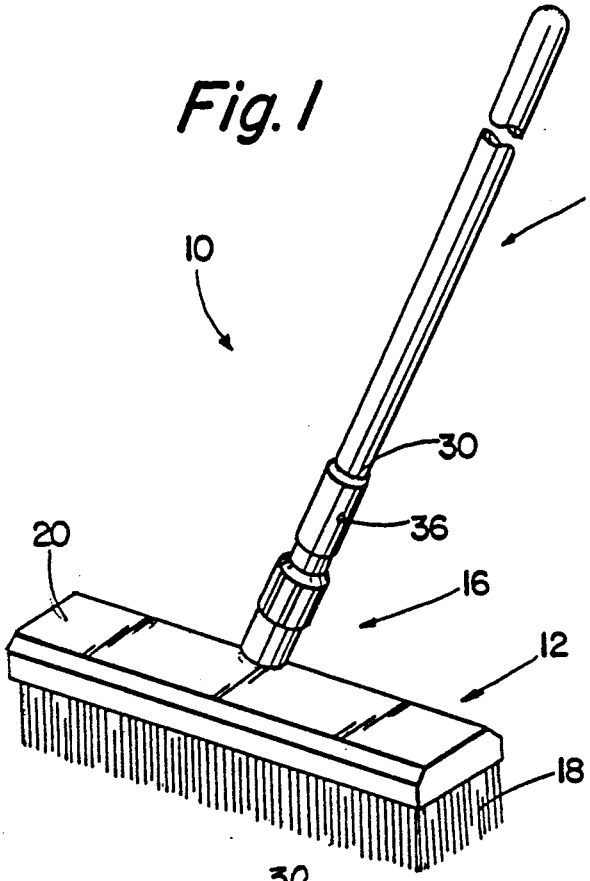
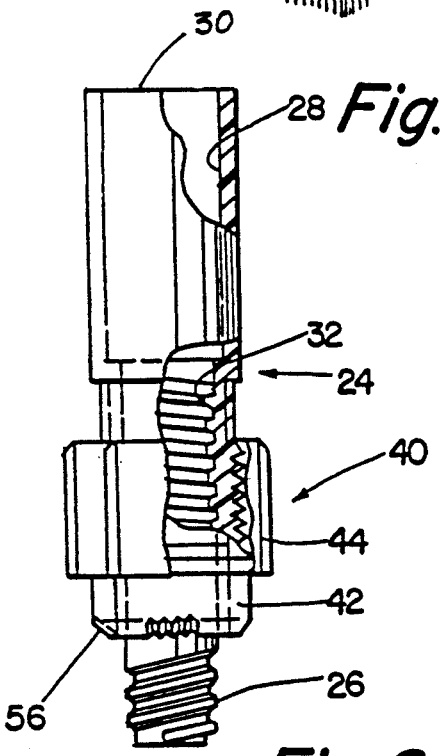
Fig. 2
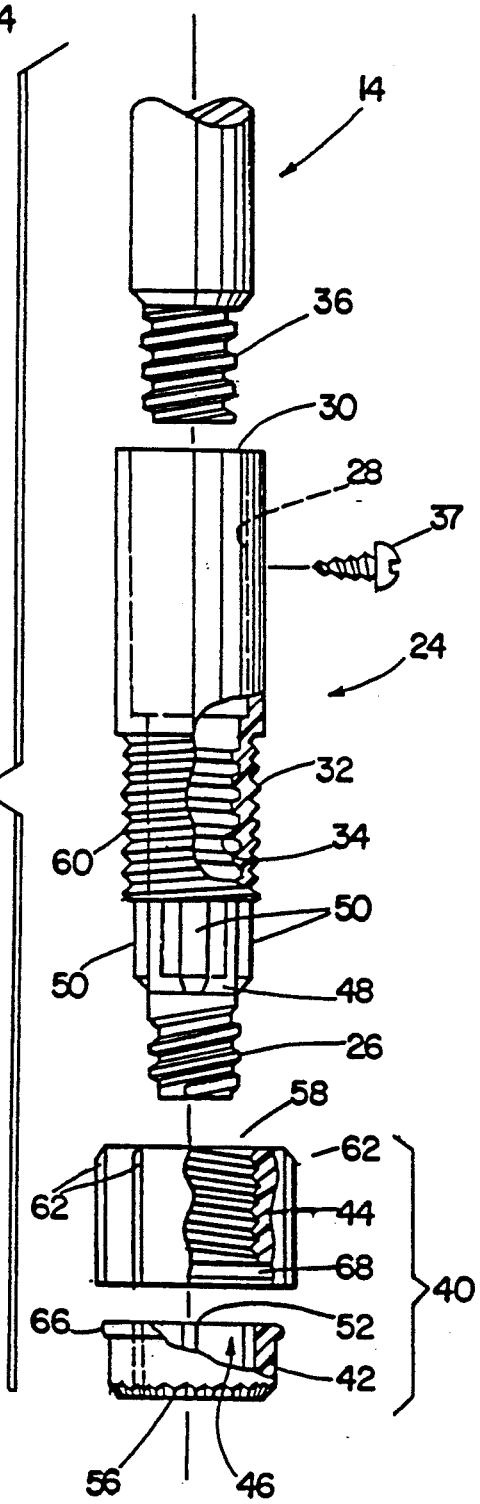

HANDLE CONNECTOR WITH ANTI-LOOSENING LOCK

BACKGROUND OF THE INVENTION

The subject invention is directed toward the art of brooms and brushes and, more particularly to a device for removably connecting a handle to such a device.

The invention is especially suited for connecting handles to cleaning implements such as sweeping brooms and scrubbing brushes and will be described with particular reference thereto; however, the invention is capable of broader application and could be used in conjunction with a variety of similar devices.

The typical sweeping broom, push broom, scrubbing brush, as well as other similar devices, is often provided with a handle which is removably connected to the head by a coarsely threaded connection. Because of the coarse thread, it frequently results that twisting forces applied to the head during usage results in unthreading which causes the handle to become loose. Of course, this renders the device functionally ineffective and greatly reduces productivity.

In an effort to eliminate the loosening problem, the user frequently screws the handle into the head with great force. Generally, the handle must be screwed into the head until the head jambs itself on the end of the threaded handle stub. This results in large lateral forces being generated in the connecting threads. Sometimes the forces are sufficient to produce longitudinal splitting in wooden broom and brush heads. And, often, the threads themselves are split, sheared, and otherwise damaged.

In addition to the above, it frequently happens that the threads on the handle are damaged by the connecting forces. Moreover, the handles themselves are sometimes weakened by the threading applied to the connecting end.

BRIEF STATEMENT OF THE INVENTION

The subject invention provides a connector assembly which can be installed on the connecting end of conventional handles to provide a high strength connecting joint which is locked against inadvertent loosening. However, the assembly is such that it can manually be readily connected and disconnected as desired.

In accordance with the invention, a broom assembly is provided which includes a head member having an internally threaded handle receiving opening with a handle connected thereto by an improved connector assembly which includes an elongated, generally cylindrical connector body which is preferably molded from plastic and has a first end threadedly received in the handle receiving opening in the head member. A second end of the connector assembly is joined to the first end of the handle. The connector assembly further includes a locking member which has a generally annular shape and is axially slidable on the connector body with a first end of the member having teeth-like protuberances which extend toward the head member. Splines are interengaged between the locking member and the connector body to prevent relative rotation of the locking member and the connector body while permitting free axial sliding movement. A threaded nut is carried on the connector body for actuating the locking member toward the head to cause the teeth-like protuberances to lockingly engage the head member. The locking engagement between the head member and the teeth-like protuberances, together with the spline arrangement, prevents relative rotation between the connector body and the head member. This prevents undesired unthreading of the threaded connection between the connector body and the head member. However, merely by releasing the threaded nut means and axially sliding the locking member away from the broom head member, unthreading of the connector from the head member is readily possible.

Preferably, and in accordance with a more limited aspect of the invention, the locking member and the nut member are interengaged by means which permit free relative rotation about the axis of the assembly while preventing undesired axial separation. While the connecting or joining means between the nut member and the locking member could take many forms, it is preferably a simple, resilient, socket-type connection.

With the joining means as described, removal of the connecting assembly from the broom head takes place while the locking member is firmly retained on the nut member to reduce the possibilities that the locking member will be lost or mislaid.

In accordance with yet another aspect of the invention, the splines for preventing relative rotation between the locking member and the connector body preferably are formed with splines integral with the connector body and extending into sliding receipt in axially extending, internal grooves formed in the locking member itself.

As is apparent from the foregoing, a primary object of the present invention is the provision of an improved connecting assembly which prevents undesired unthreading between a broom handle and the associated head member.

A further object is the provision of a connector of the general type described which can be readily formed using conventional injection molding techniques.

A still further object is the provision of a locking connector assembly which can be readily released manually and which can accept a conventional handle and which does not require special modification of either existing broom heads or handles.

BRIEF DESCRIPTION OF THE DRAWINGS

The above and other objects and advantages will become apparent from the following description when read in conjunction with the accompanying drawings wherein:

FIG. 1 is a pictorial view of a broom which incorporates an improved handle connector assembly formed in accordance with a preferred embodiment of the invention;

FIG. 2 is an enlarged side elevational view of the connector assembly of FIG. 1;

FIG. 3 is an exploded view showing the various components of the connector assembly of FIG. 2 (portions have been cut away to more clearly show internal details of the assembly's components);

DETAILED DESCRIPTION OF THE PREFERRED AND ALTERNATE EMBODIMENTS

Figure 4:
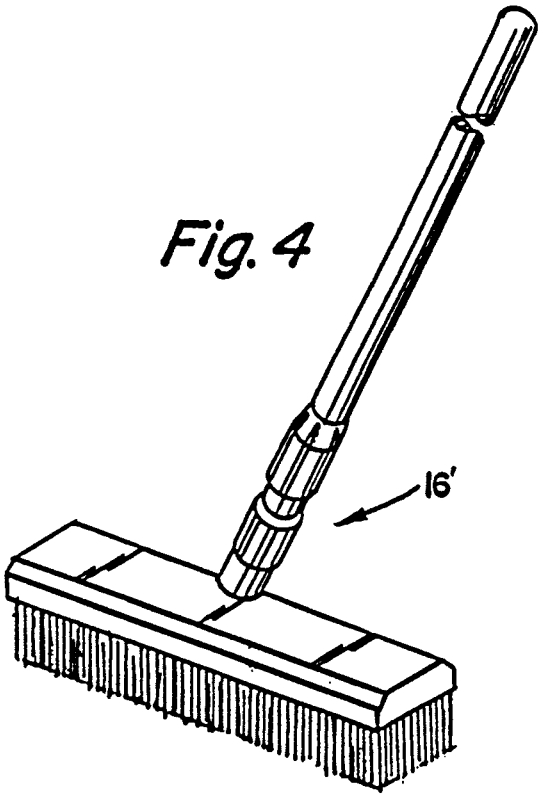
FIG. 4 is a pictorial view similar to FIG. 1 but showing a slightly modified form of the invention.

Referring more particularly to the drawings wherein the showings are for the purpose of illustrating preferred embodiments of the invention only, and not for the purpose of limiting same, FIG. 1 shows the overall arrangement of a push broom assembly 10 which comprises a head member 12 and a handle 14 which are interconnected by an improved connecting assembly 16. As will become apparent, the subject invention is applicable to a variety of different types of broom, brush, and mop-type devices and, as used herein, the general term "broom head" is intended to encompass the head assembly of any of this particular class of manually manipulated implements. In the embodiment under consideration, the broom head element 12 is an elongated head generally of the pushbroom type having the bristles 18 extending from one face thereof, and the handle assembly 14 extending from the opposite face at an angle relative thereto. The actual body 20 of the broom head assembly 12 can be formed from any of a variety of materials including wood or plastic. The typical means for connecting the handles to such heads is a coarsely threaded opening formed into the head body 20 at the angle desired for the handle member. Typically, the threads are a relatively coarse, Acme-type thread.

For the reasons discussed at length above, the problem with such connections between the broom head and the handle is the difficulty in maintaining the handle and head properly interconnected and overcoming a general tendency to loosen during use as the result of torque or twisting forces applied to the head. To overcome this problem, the subject invention incorporates an improved connecting assembly 16 between the head 12 and the handle assembly 14. As best shown in FIGS. 2 and 3, the connecting assembly 16 comprises a somewhat cylindrically shaped, axially elongated connector body 24. The connector body 24 is preferably formed from a relatively, rigid high strength plastics material, such as nylon, polyethylene, or the like. As illustrated, the first or lower end of the body 24 is provided with a short, threaded stub portion 26 which has a diameter and thread formation which is sized to be received in the corresponding threaded opening of the head member 20. In effect, the stub portion 26 duplicates the threaded end normally found on the handles used with the typical push broom head illustrated in FIG. 1.

At the second or upper end of the cylindrical body 24, means are provided for receiving and connecting to the handle 14. In the subject embodiment, these connecting means comprise an inwardly extending cylindrical opening 28 which extends axially into body 26 from the open upper end 30. The diameter of opening 28 is such as to closely and slidably receive the handle 14. Additionally, the length or depth of the opening 26 is preferably sufficient so as to provide a relatively positive and strong sleeve connection with handle 14. In the subject embodiment, the connecting assembly at the upper end further includes a threaded lower end on the opening 28. This threaded lower end is identified with the reference numeral 32 and has the threads shown as relatively coarse, Acme-type threads 34 sized to correspond to the threads 36 formed on the lower end of the elongated handle 14. The handle 14 can thus be entered into the opening 28 and firmly threaded into connection with the threaded lower end 32. After threading, inadvertent removal from the connecting body 24 can be prevented by suitable cross pinning or through the use of a screw member 36 screwed through the connector body 24 to firmly engage with handle 14 and prevent relative rotation.

It should be noted that the combined threaded and unthreaded portions of the connecting end of the connector body 24 allows the connector to be applied either to threaded or unthreaded handles 14.

In order to prevent the connector body 24 from being unthreaded from the head 20 during normal usage and as a result of inadvertent application of torque or impact to the head, a lock assembly is carried on the central portion of the connector body 24. This locking assembly is identified generally with the reference numeral 40 and comprises a lock ring member 42 and a nut member 44. Nut member 42 is a generally annular body formed from a comparatively hard plastic, such as a hard, fiber filled nylon. The central opening 46 through the lock member 42 is sized so as to be freely receivable axially onto the reduced diameter lower end portion 48 of the connecting body 24. The lock member 42 is prevented from rotating relative to the body 24 by cooperating splines and grooves between the lock member and the body 24. Specifically, the body 24 includes four circumferentially spaced and radially extending ribs or spline members 50 which are formed as best seen in FIG. 3. The splines or ribs 50 are sized and arranged to engage in correspondingly shaped and positioned internal grooves 52 formed about the interior of the lock member 42.

The lower end face of the lock member 42 is provided with a plurality of relatively sharp tooth-like protuberances 56 which extend both across the lower end face and upwardly at approximately a 45° angle. These tooth-like protuberances are preferably shaped and arranged such that they can be driven into biting engagement with the surface of the broom head member 20 about the handle receiving opening.

As noted, the locking assembly 40 further includes the previously-mentioned nut 44. Nut 44 is of cylindrical, annular shape and has a central threaded opening 58 formed therethrough. Opening 58 and the threads therein are sized so as to be threadedly received on the externally threaded central portion 60 of the connector body 24. Thus, rotation of the nut 44 on the body 60 causes it to move axially. It is related to the upper end of the lock member 42 so that it can act to drive the lock member 42 toward the lower end of body 24 to bring it into biting engagement with the head element 20 as illustrated in FIG. 1. As can be appreciated, after the lower end 26 of the connector body 24 has been suitably tightened into position in the head member 20 tightening of the nut member 44 to drive the lock member 42 down into engagement with the head 20 prevents relative unthreading of the connector body 24 from the head 20. That is, the lock member 42 bites into the head.

Preferably, the exterior of the nut member 44 is provided with small, axially extending ribs 60 to facilitate manual gripping and tightening of the nut member. To release the connecting body from the head, it is only necessary to slightly unscrew or release the nut 44 from forcible engagement with the upper end of the lock member 42. The lock member can then be moved slightly away from the head 20 and the connector body 24 unthreaded from the head 20.

Preferably, the nut member 44 and the lock member 42 are interconnected by joining means which prevent undesired axial separation of the two elements while permitting free relative rotation as is required for the locking and unlocking of the connecting member 24 in the head 20. In the embodiment of FIGS. 1 through 3, the joining means take the form of a radially extending small bead or flange 66 of arcuate cross-section formed circumferentially about the upper end of the lock member 42. The circumferentially extending bead 66 is adapted to be snapped into a correspondingly shaped recess or groove 68 formed circumferentially about the lower inner end of the nut 44. The two elements can then be snapped axially together and will retain this interengaged relationship throughout normal usage. The interengagement is such, however, as to permit free relative rotation of the two components.

Figure 5:
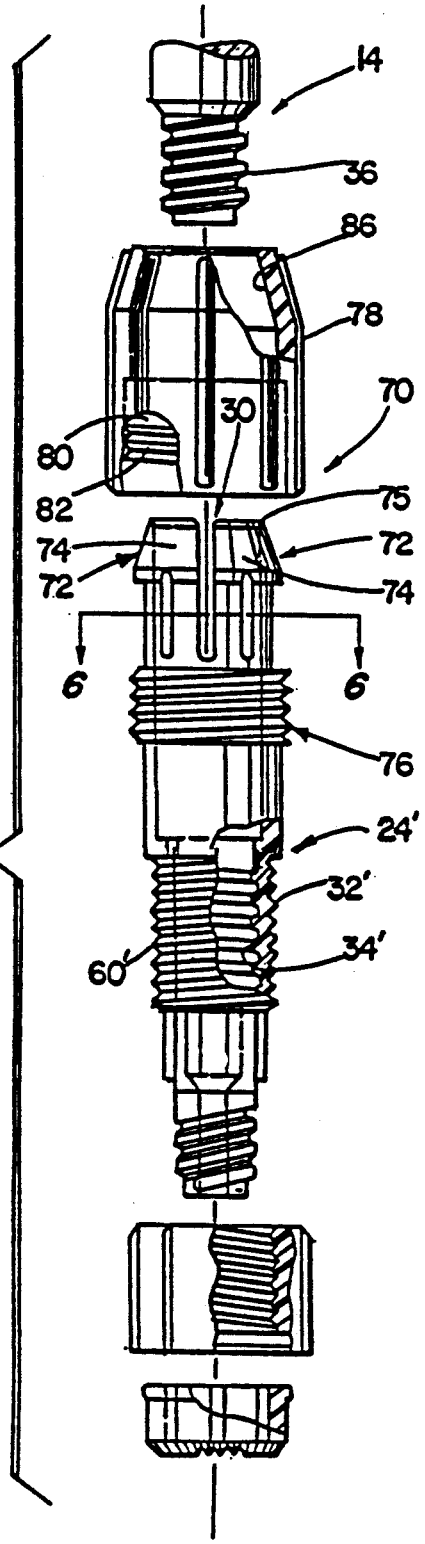
FIG. 5 is an exploded view showing in detail the connector assembly of the FIG. 4 embodiment; and, FIG. 6 is a cross-sectional view taken on line 6—6 of FIG. 5.

FIGS. 4 and 5 show a second embodiment of the subject invention. In this embodiment, the elements which correspond to those previously discussed with respect to the FIGS. 1 through 3 embodiment have been identified with the same reference numerals differentiated by the addition of a prime (') suffix. The description of the correspondingly numbered element is to be taken as equally applicable unless otherwise noted. More particularly, in the FIGS. 4 and 5 embodiment, the connecting assembly 16' is generally the same as the previously-discussed connecting assembly 16 except for the manner in which the upper end of the connector body 24' joins to the handle 14'. Specifically, in the FIGS. 4 and 5 embodiment, the handle 14' is connected to the connector body 24' by a manually operable collet assembly 70. The collet assembly 70 includes a plurality of axially extending resilient fingers (in this case four) generally identified with the reference numeral 72. The resilient fingers 72 are molded integrally on the upper end of the connector body 24' and are freely deflectable in a radial direction. To increase the flexibility of the fingers 72, they are provided with vertically extending oval slots or openings 73. The openings 73 extend completely through fingers 72. The outer or free end of each finger has an inclined surface as shown at 74. Each inclined surface 74 tapers radially inward from the lower end to the outer free end.

At the inner surface of the upper ends of the resilient fingers 72, there are inclined surfaces 75 which act to provide somewhat of a bell mouth to the handle receiving open end 30'. This has the advantage of facilitating handle insertion especially after the assembly has been in use and the fingers 72 have taken a slight radial inward set as may sometimes happen with the locking of the nut around a smaller handle. Beneath the fingers 72 is an externally threaded section 76 formed about the central section of connector body 24'.

The collet assembly further includes a manually operable collet nut member 78 which is provided with a central, axially extending opening so which extends the length therethrough. Suitable threads 82 are formed about the lower end of the opening 80 for cooperation and engagement with the threads 76 on body member 24'. The upper end of the opening 80 is conically configured and inclined as shown at 86. This conical section 86 is arranged such that when the manually operable nut 78 is position on the upper end of the connector body 24', tightening of the nut member 78 causes radial inward deflection of the fingers 72. As can be appreciated, with the handle 14' in position in the central openings 28' and 32', a tightening of the collet nut 78 causes a circumferential gripping of the handle by the collet fingers 72 to prevent undesired disconnection of the handle from the threaded portion 34 of opening 32.

Figure 6:
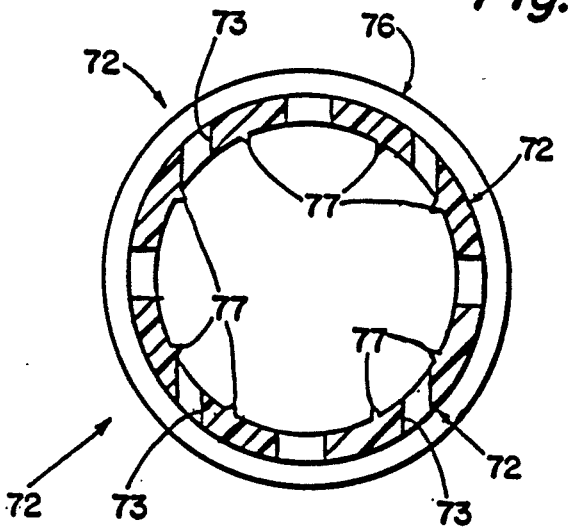

The ability of the fingers 72 to grip the exterior surface of handles inserted in opening 30' is further enhanced by vertically extending ribs or teeth 77 (see FIG. 6) formed about the interior surfaces of the fingers. Preferably, the tips of the teeth 77 are relatively sharp to increase the engagement forces.

The design of the collet assembly and the resilient fingers are such that the assembly is capable of tightly gripping handles of significantly different diameters. For example, handles varying by as much as ⅛" and more in diameter can be tightly gripped and held against undesired rotation.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having described the invention, it is claimed:

1. A broom assembly comprising:

a broom head member having an internally threaded handle receiving opening formed therein;

an elongated handle connected with the head member by a connector assembly positioned between said head member and a first end of the elongated handle;

the connector assembly including; an elongated, generally cylindrical connector body having a first end threadedly received in the handle receiving opening in the head member and a second end joined to the first end of the elongated handle, a locking member having a generally annular shape and axially slidable on the connector body with a first end of the member having teeth-like protuberances extending toward the head member, spline means for preventing rotation of the locking member relative to the connector body, and threaded nut means carried on the connector body for actuating the locking member toward the head to cause the teeth-like protuberances to lockingly engage the head member.

2. The assembly as defined in claim 1 wherein the second end of the connector body includes a cylindrical opening on the second end which receives the first end of the elongated handle.

3. The assembly as defined in claim 1 wherein the connector body has a collet member formed on the second end for joining the connector body to the first end of the elongated handle.

4. The assembly as defined in claim 1 wherein the spline means comprises a plurality of axially extending ribs formed on the connector body adjacent the first end.

5. The assembly as defined in claim 4 wherein the spline means further includes grooves formed internally of the locking member to receive the axially extending ribs.

6. The assembly as defined in claim 4 wherein the locking member is molded from a relatively hard, rigid plastics material.

7. The assembly as defined in claim 1 wherein the nut means comprises an internally threaded nut received on external threads formed on the connector body, the nut having an end which directly engages the locking member.

8. The assembly as defined in claim 1 wherein the connector body has an internally threaded opening extending axially into the second end for receiving the first end of the elongated handle.

9. The assembly as defined in claim wherein the connector body is a unitary element molded from plastics material.

10. The assembly as defined in claim 1 wherein the locking member is joined to the nut means by joining means for permitting free relative rotation while preventing undesired axial separation.

11. The assembly as defined in claim 10 wherein the joining means comprise a socket formed in the nut means.

12. The assembly as defined in claim 10 wherein the joining means comprises resilient interengaging elements.

* * * * *